US007866577B2

(12) United States Patent
Yoshimaru et al.

(10) Patent No.: US 7,866,577 B2
(45) Date of Patent: Jan. 11, 2011

(54) FUEL INJECTION VALVE

(75) Inventors: Kiyotaka Yoshimaru, Obu (JP); Toyoji Nishiwaki, Anjo (JP)

(73) Assignee: Denso Corporation, Kariya (JP)

( * ) Notice: Subject to any disclaimer, the term of this patent is extended or adjusted under 35 U.S.C. 154(b) by 133 days.

(21) Appl. No.: 12/339,996

(22) Filed: Dec. 19, 2008

(65) Prior Publication Data

US 2009/0159729 A1 Jun. 25, 2009

(30) Foreign Application Priority Data

Dec. 21, 2007 (JP) ..... 2007-330282

(51) Int. Cl.
*B05B 1/30* (2006.01)

(52) U.S. Cl. ..... 239/585.1; 239/585.4; 239/533.12

(58) Field of Classification Search ..... 239/585.1, 239/585.2, 585.3, 585.4, 585.5, 533.2, 533.9, 239/533.12, 88–96, 584; 251/129.15, 129.21, 251/127

See application file for complete search history.

(56) References Cited

U.S. PATENT DOCUMENTS

| | | | | |
|---|---|---|---|---|
| 5,544,816 | A * | 8/1996 | Nally et al. | 239/585.5 |
| 6,079,642 | A * | 6/2000 | Maier | 239/585.1 |
| 6,089,467 | A * | 7/2000 | Fochtman et al. | 239/5 |
| 6,173,915 | B1 * | 1/2001 | Cohen et al. | 239/585.1 |
| 6,390,067 | B1 * | 5/2002 | Haltiner et al. | 123/470 |
| 7,252,245 | B2 | 8/2007 | Nishiwaki | |
| 2007/0057218 | A1 | 3/2007 | Kuno | |
| 2007/0235669 | A1 | 10/2007 | Suzuki et al. | |

FOREIGN PATENT DOCUMENTS

| | | |
|---|---|---|
| JP | 63-193771 | 12/1988 |
| JP | 10-030517 | 2/1998 |
| JP | 2000-265919 | 9/2000 |
| JP | 2003-148280 | 5/2003 |
| JP | 2004-011448 | 1/2004 |
| JP | 2004-068677 | 3/2004 |
| JP | 2005-163712 | 6/2005 |
| JP | 2005-171845 | 6/2005 |

OTHER PUBLICATIONS

Japanese Office Action dated Oct. 27, 2009, issued in corresponding Japanese Application No. 2007-330282, with English translation.

* cited by examiner

*Primary Examiner*—Davis Hwu
(74) *Attorney, Agent, or Firm*—Nixon & Vanderhye PC

(57) ABSTRACT

A fuel injection valve includes a housing, a stator, a movable core, a coil, a nozzle hole, a valve member, and at least one communicating passage. The housing receives the stator and movable core. An end face of the movable core has a non-contact surface and a contact surface. The non-contact surface and the stator define a space when the contact surface contacts the stator. The valve member is slidably received in a bore of the movable core. The valve member has a stopper engageable with the movable core such that the valve member is axially movable together with the movable core. The at least one communicating passage connects the space with a corresponding one of a first fuel passage and a second fuel passage of the housing.

13 Claims, 14 Drawing Sheets

FUEL INJECTION VALVE

CROSS REFERENCE TO RELATED APPLICATION

This application is based on and incorporates herein by reference Japanese Patent Application No. 2007-330282 filed on Dec. 21, 2007.

BACKGROUND OF THE INVENTION

1. Field of the Invention

The present invention relates to a fuel injection valve for injecting fuel into an internal combustion engine or the like.

2. Description of Related Art

A conventional fuel injection valve includes a needle (valve member), which is driven electromagnetically to inject fuel into an internal combustion engine or the like (JP 2006-17101A, which corresponds to U.S. Pat. No. 7,252,245, and JP 2005-171845 A).

FIG. 15 of the accompanying drawings shows a conventional fuel injection valve (an injector) 91. The valve 91 includes a housing 910, which defines a fuel passage 96 therein, a movable core 922, and a needle 940. The core 922 and the needle 940 are integral with each other and is reciprocable axially in the housing 910. The needle 940 is biased by a compression spring 926 to close the valve 91.

The fuel injection valve 91 further includes a stator 921 and a coil 951. When current is supplied to the coil 951, magnetic attractive force is developed between the stator 921 and the movable core 922. The attractive force moves the core 922 and the needle 940 toward the stator 921 against the force of the compression spring 926 to open the valve 91. When the current supply to the coil 951 is cut off or the coil 951 is deenergized, the force of the spring 926 moves the core 922 and the needle 940 away from the stator 921 to close the valve 91.

When the coil 951 is supplied with current or is energized, the movable core 922, which is integral with the needle 940, collides with the stator 921 and bounces off the stator 921. As a result, particularly if the fuel injection valve 91 is driven for a short period of time, the injection quantity is not proportional to the time period, so that the quantity is difficult to control. As a result, it is impossible to reduce the minimum controllable injection quantity disadvantageously.

In order to solve this problem, a fuel injection valve is proposed, in which the movable core and the stator have a large contact area between them. As a result, the large contact area enlarges squeezing force developed between the movable core and the stator, and thereby a small bounce occurs when the coil of the fuel injection valve is supplied with current in the event of opening the valve. However, the large squeezing force makes the needle of the fuel injection valve less responsive in the event of closing the valve. This disadvantageously increases the minimum controllable injection quantity or causes another disadvantage associated with the injection characteristic of the fuel injection valve.

SUMMARY OF THE INVENTION

The present invention is made in view of the above disadvantages. Thus, it is an objective of the present invention to address at least one of the above disadvantages.

To achieve the objective of the present invention, there is provided a fuel injection valve, which includes a tubular housing, a tubular stator, a tubular movable core, a coil, a nozzle hole, a valve member, and at least one communicating passage. The housing defines a fuel channel therein, through which fuel flows. The stator is received in the housing. The movable core is received in the housing. The movable core is axially opposed to the stator. The movable core defines a bore formed therethrough. The movable core has an end face adjacent to the stator. The end face has a region that is opposed to the stator. The region includes a non-contact surface, which is prevented from contacting the stator, and a contact surface, which is adapted to contact the stator. The non-contact surface and the stator define a space therebetween when the contact surface contact the stator. The coil is adapted to generate a magnetic field when the coil is energized to develop magnetic attractive force between the stator and the movable core, and the magnetic attractive force causes the stator to attract the movable core such that the contact surface of the movable core is brought into contact with the stator. The nozzle hole is positioned on a downstream end of the housing in a flow direction of fuel. The valve member is slidably received in the bore of the movable core. The valve member extends through the bore. The valve member is separate from the movable core. The valve member includes a body and a stopper that radially outwardly projects from the body. The stopper of the valve member is configured to engage with the movable core such that the valve member is axially movable together with the movable core to open or close the fuel channel of the housing in order to control injection of fuel through the nozzle hole. The at least one communicating passage is coupled to the space. The fuel channel includes a first fuel passage defined inside the stator upstream of the movable core in the flow direction and includes a second fuel passage located downstream of the movable core in the flow direction. The at least one communicating passage connects the space with a corresponding one of the first fuel passage and the second fuel passage.

BRIEF DESCRIPTION OF THE DRAWINGS

The invention, together with additional objectives, features and advantages thereof, will be best understood from the following description, the appended claims and the accompanying drawings in which;

DETAILED DESCRIPTION OF PREFERRED EMBODIMENTS

First Embodiment

FIGS. 1, 2A, 2B, and 3 show a fuel injection valve (an injector) 1 according to the first embodiment of the present invention.

Figure 1:
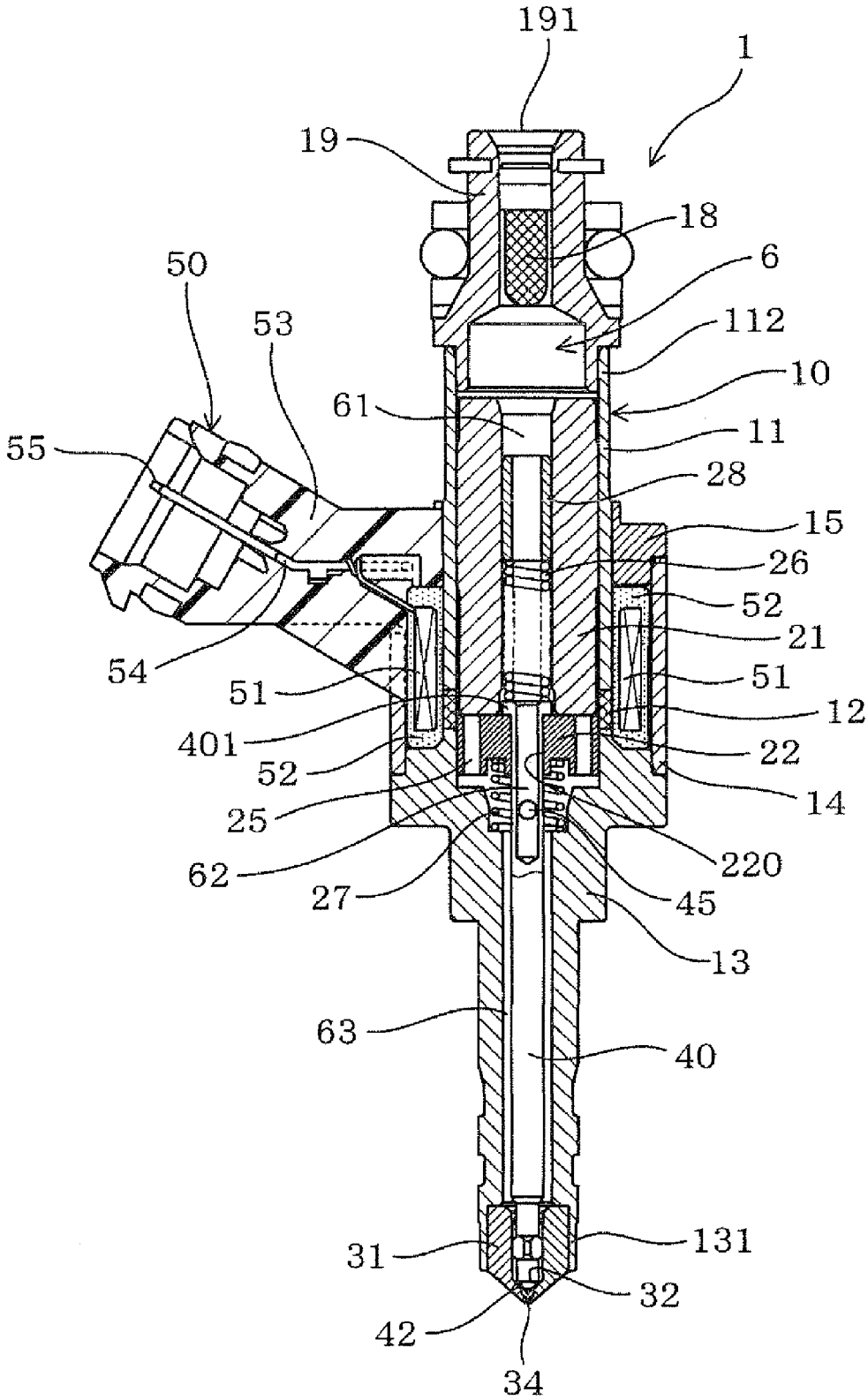
FIG. 1 is an axial section of a fuel injection valve according to the first embodiment of the present invention.

With reference to FIG. 1, the fuel injection valve 1 is mounted on the head of a direct-injection gasoline engine (not shown) but may be alternatively used for an indirect-injection gasoline engine or a diesel engine.

The fuel injection valve 1 has a nozzle hole 34 formed at a front end of the valve 1. The front end of the fuel injection valve 1 corresponds to a downstream side of the fuel injection valve 1 in a flow direction of fuel. Also, a rear end of the fuel injection valve 1 corresponds to an end of the valve 1 opposite from the front side, and corresponds to an upstream side of the valve 1 in the flow direction.

The fuel injection valve 1 includes a tubular housing 10 that defines a fuel channel 6 therein. The housing 10 includes a pipe 11, a tubular non-magnetic part 12, and a tubular holder 13, which are integrated with each other through laser welding or the like.

A tubular stator 21 is received in a radially inner side of the pipe 11 and is press-fitted into the pipe 11. The stator 21 receives an adjusting pipe 28 and a first compression spring 26 therein on a radially inner side of the stator 21. The pipe 11 and stator 21 are made of magnetic material.

An external connector 19 is press-fitted into the rear end 112 of the pipe 11 and has a fuel inlet 191 formed in a rear end of the external connector 19. A fuel pump (not shown) supplies the fuel inlet 191 with fuel from a fuel tank (not shown). The external connector 19 is fitted with a filter element 18 therein, through which the fuel supplied to the inlet 191 flows into a fuel passage 61 inside the pipe 11. The filter element 18 removes foreign substances from the fuel, and the fuel passage 61 corresponds to the first fuel passage of the fuel channel 6.

The front end of the pipe 11 is fixed to the rear end of the non-magnetic part 12, which is made of non-magnetic material. The front end of the non-magnetic part 12 is fixed to the rear end of the holder 13, which is made of magnetic material. The non-magnetic part 12 prevents short-circuiting between the pipe 11 and holder 13, which are made of magnetic material.

The front end 131 of the holder 13 receives a tubular valve body 31 therein, which is fixed to the front end 131 of the holder 13 through press fitting, welding, or the like. The valve body 31 has an inner conical surface converging toward the front end thereof. A valve seat 32 is formed on the conical surface. The nozzle hole 34 is defined to extend through the front end part of the valve body 31 and provides communication between the inside and outside of the valve body 31. Multiple nozzle holes 34 may be alternatively formed.

The holder 13 receives a tubular movable core 22 and a tubular needle 40 therein. The movable core 22 is reciprocable axially in the holder 13 and is made of magnetic material. The needle 40 serves as a valve member and is reciprocable axially with together with the movable core 22. The needle 40 is provided substantially coaxially with the valve body 31. The needle 40 includes a sealing part 42 formed at the front end of the needle 40. The sealing part 42 is adapted to be seated on the valve seat 32.

A fuel passage 62 is defined axially inside the needle 40 and a fuel hole 45 is defined radially in the needle 40. The fuel in the needle 40 flows through the fuel passage 62 and through the fuel hole 45 into a fuel passage 63 that is defined between the outer peripheral surface of the needle 40 and the inner peripheral surface of the holder 13. The fuel passage 62 is a part of the fuel channel 6, and the fuel passage 63 corresponds to a second fuel passage of the fuel channel 6. As above, the fuel channel 6 is defined in the housing 11, and more specifically, the fuel channel 6 includes the passage 61 defined in the stator 21, the passage 62 defined in the needle 40, and the passage 63 defined outside the needle 40.

The movable core 22 and the needle 40 are separate from each other and are movable axially relative to each other. The movable core 22 has a bore 220 formed to extend through the movable core 22, and the needle 40 is slidable through the bore 220.

Figure 2A:
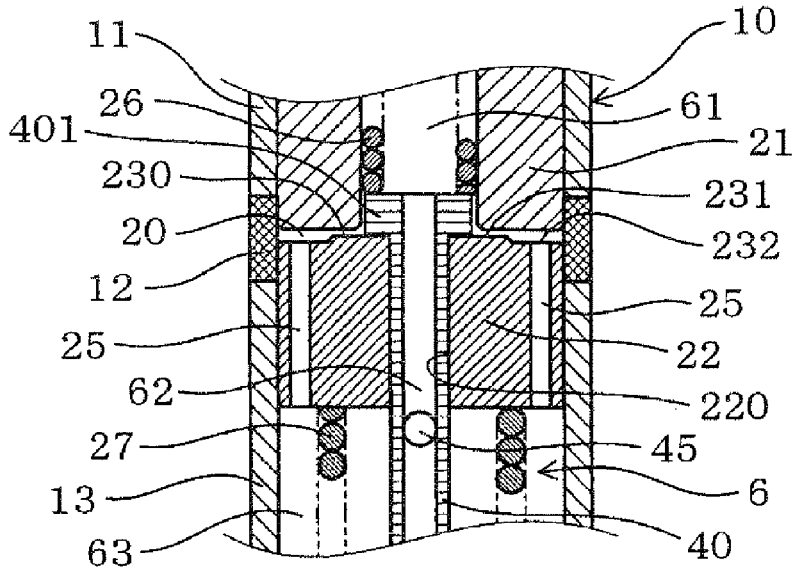
FIG. 2A is an enlarged axial section of part of the fuel injection valve according to the first embodiment, in a state, where the valve is closed.
Figure 2B:
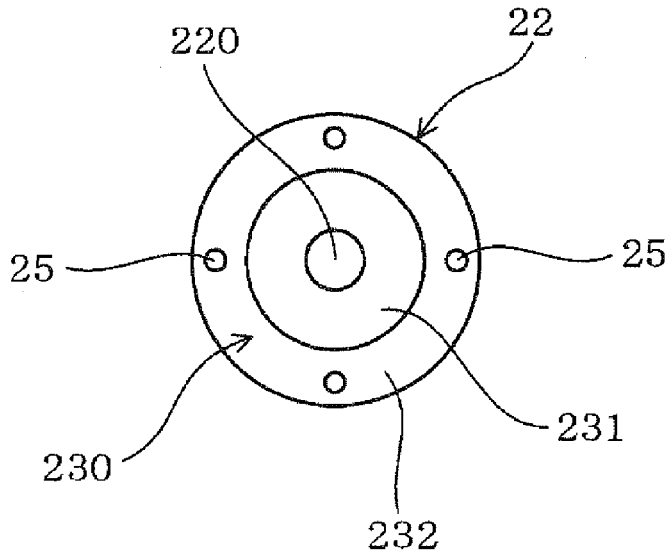
FIG. 2B is a rear end view of the movable core of the fuel injection valve according to the first embodiment.

As shown in FIGS. 2A and 2B, the rear end face 230 of the movable core 22 includes a region or a section that is opposed to the stator 21. The facing region has a contact surface 231 and a non-contact surface 232. The stator 21 attracts the movable core 22 so that the contact surface 231 is brought into contact with the stator 21. The non-contact surface 232 is prevented from contacting the stator 21. An annular space 20 is defined between the stator 21 and the non-contact surface 232.

In the present embodiment, a part of the facing region of the core end face 230 protrudes as the contact surface 231, and the other part of this region is the non-contact surface 232, which is provided radially outward of the contact surface 231.

As shown in FIGS. 2A and 2B, the movable core 22 defines multiple communicating passages 25 that extend through the movable core 22. The communicating passages 25 connect the annular space 20 with the fuel passage 63 of the holder 13 located downstream of the movable core 22.

In the present embodiment, the communicating passages 25 extend axially through the movable core 22 and open in the non-contact surface 232. Four communicating passages 25 are arranged one after another at intervals of 90 degrees near the outer peripheral edge of the movable core 22, and each of the communicating passages 25 has a circular shape in section.

As shown in FIG. 1, the rear end of the needle 40 has a needle stopper 401 that radially outwardly projects from a tubular body of the needle 40. The needle stopper 401 has a rear end surface that is in compressive contact with the front end of the first compression spring 26 serving as an elastic member. The rear end of the first compression spring 26 is in compressive contact with the front end of the adjusting pipe 28. The front end of the movable core 22 is in compressive contact with the rear end of a second compression spring 27 that serves as another elastic member. The two elastic members are not limited to compression springs but may be leaf springs, gas dampers, or liquid dampers. Also, the needle stopper 401 has a front end surface that is engageable with the rear end face 230 of the movable core 22.

As stated above, the adjusting pipe 28 is press-fitted into the stator 21. The load on the first compression spring 26 varies with the axial position of the adjusting pipe 28 relative to the stator 21. The first compression spring 26 has axially compressive force and biases the needle 40 and movable core 22, which are integral with each other, so that the sealing part 42 is seated on the valve seat 32. The second compression spring 27 biases the movable core 22 to keep the rear end of the movable core 22 in compressive contact with the needle stopper 401 of the needle 40. As a result, the needle 40 is axially movable together with the movable core 22 to open or close the fuel channel 6 of the housing 10 in order to control injection of fuel through the nozzle hole 34.

A coil assembly 50 is provided radially outward of the pipe 11 and is constructed integrally of a hollow cylindrical coil 51, a molding 52, and an electric connector 53. The coil 51 is covered with the molding 52, which is made of resin. The inner and outer peripheries of the coil 51 are covered with the molding 52. The coil 51 circumferentially and continuously covers the outer peripheral side of the pipe 11. The molding 52 and electric connector 53 are formed integrally of resin. The coil 51 is connected to the terminal 55 of the electric connector 53 by a wiring member 54.

A cylindrical plate housing 14 is provided radially outward of the outer periphery of the coil 51 or the plate housing 14 receives the coil 51. The coil 51, which is covered with the molding 52, is held between the plate housing 14 and pipe 11. The rear end of the molding 52 is covered with a cover 15. The plate housing 14 and cover 15 are made of magnetic material.

The operation of the fuel injection valve 1 will be described below.

While the coil 51 is supplied with no current or when the coil 51 is deenergized, no magnetic attractive force is developed between the stator 21 and the movable core 22, so that the first compression spring 26 keeps the core 22 out of contact with the stator 21, as shown in FIG. 2A. Accordingly, while the coil 51 is supplied with no current, the sealing part 42 of the needle 40 is seated on the valve seat 32 (the valve is closed), so that no fuel is injected through the nozzle hole 34.

Figure 3:
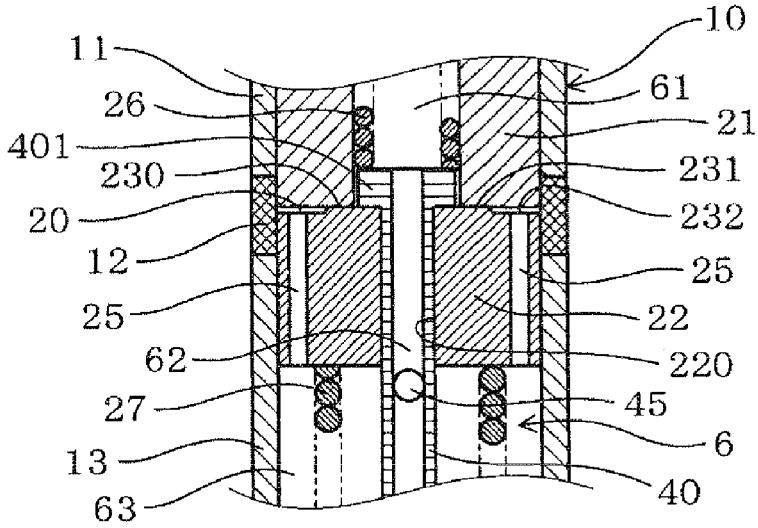
FIG. 3 is an enlarged axial section of part of the fuel injection valve according to the first embodiment, in a state, where the valve is opened.

When the coil 51 is supplied with current or when the coil 51 is energized, a magnetic field is generated on the coil 51. The magnetic field creates magnetic fluxes in the magnetic circuit formed by the housing plate 14, the holder 13, the movable core 22, the stator 21, and the cover 15. This develops a magnetic attractive force between the stator 21 and the movable core 22, which are out of contact with each other. If the attractive force exceeds the force of the first compression spring 26, then the movable core 22 and the needle 40 move toward the stator 21 until the contact surface 231 of the core 22 comes into contact with the stator 21, as shown in FIG. 3. As a result, the sealing part 42 of the needle 40 becomes out of contact with or disengaged from the valve seat 32, and thereby the valve is open.

The fuel having flowed into the fuel inlet 191 flows through the filter element 18, a fuel passage 61 inside the pipe 1 the adjusting pipe 28, the fuel passage 62 inside the needle 40, and the fuel hole 45 into the fuel passage 63 outside the needle 40. Then, the fuel flows from the fuel passage 63 through the space between the valve body 31 and the needle 40, which is currently out of contact with the valve seat 32, and is injected through the nozzle hole 34.

When the current supply to the coil 51 is cut off or when the coil 51 becomes deenergized, no magnetic attractive force is developed between the stator 21 and the movable core 22, so that the first compression spring 26 moves the movable core 22 and the needle 40 away from the stator 21. This brings the movable core 22 out of contact with the stator 21, as shown in FIG. 2A, and seats the sealing part 42 of the needle 40 again on the valve seat 32 (the valve is closed), so that the injection of fuel through the nozzle hole 34 stops.

Advantages of the fuel injection valve 1 will be described below.

As stated already, magnetic attractive force is developed between the stator 21 and the movable core 22 when the coil 51 is supplied with current. The attractive force moves the movable core 22 into contact with the stator 21, and thereby the needle 40 moves toward the stator 21, so that the fuel injection valve 1 opens.

In the present embodiment, the facing region of the rear end face 230 of the movable core 22 has a contact surface 231 and a non-contact surface 232. The contact surface 231 comes into contact with the stator 21 when the stator attracts the movable core 22. The non-contact surface 232 does not come into contact with the stator 21. The annular space 20 is formed between the non-contact surface 232 and the stator 21. The movable core 22 has the communicating passages 25, and the communicating passages 25 provides communication between the annular space 20 and the fuel passage 63 in the holder 131 which corresponds to the second fuel passage of the fuel channel 6 located downstream of the core 22.

When the fuel injection valve 1 opens, only the contact surface 231 of the movable core 22 comes into contact with the stator 21, with the non-contact surface 232 out of contact with the stator 21. In other words, even while the movable core 22 is in contact with the stator 21, the annular space 20 keeps the non-contact surface 232 out of contact with the stator 21. The annular space 20 and the communicating passages 25, which communicate with this space, allow the fuel between the movable core 22 and the stator 21 to escape to the fuel channel 6.

When the movable core 22 comes into contact with the stator 21, fuel is compressed between the movable core 22 and the stator 21. The compressed fuel is enabled to flow from the annular space 20 into the communicating passages 25. This reduces the fluid resistance acting on the movable core 22 when the fuel injection valve 1 opens. The resistance reduction improves the responsibility of the needle 40 for moving with the movable core 22. Specifically, the resistance reduction increases the speed at which the needle 40 moves out of contact with the valve seat 32. The increased speed shortens the time taken by the fuel injection valve 1 to have opened after starting to open. Specifically, the needle stopper 401 has an outer peripheral part, and the stator 21 has an inner peripheral part that radially opposed to the outer peripheral part of the needle stopper 401. The outer peripheral part of the needle stopper 401 and the corresponding inner peripheral part of the stator 21 defines a restrictor therebetween, which advantageously restricts communication of fuel between the stator 21 and the movable core 22.

In the present embodiment, the movable core 22 and the needle 40 are separate parts. The needle 40 is slidable through the bore 220 of the movable core 22. The movable core 22 and the needle 40 are separate parts. In other words, the movable core 22 and the needle 40 are not fixed to each other, and thereby the movable core 22 and the needle 40 are independently movable axially relative to each other.

During an event of opening the fuel injection valve 1, the movable core 22 moves with the needle 40 toward the stator 21. Due to the above separate structure of the movable core 22 and the needle 40, the inertial weight of only the movable core 22 is applied to the stator 21 when the movable core 22 collides with the stator 21. More specifically, when the movable core 22 collides with the stator 21, the impact provides a reaction force that is applied to the core 22 in a direction away from the stator 21. In the above, the reaction force corresponds to the inertial force of the moving core 22 in magnitude. In contrast, the needle 40 does not receives the force applied in the direction away from the stator 21, (in other words, the inertial force is kept applied to the needle 40 in a direction toward the stator 21) because the needle 40 does not collides with the stator 21 and because the needle 40 is independent of the movable core 22. Thus, the above inertial force keeps the needle 40 moving in the direction toward the stator 21.

Accordingly, the inertial weight (collision energy) exerted when the movable core 22 collides with the stator 21 is lighter than another case, where the core 22 and stator 21 were fixed to each other. This greatly suppresses the bounce of the movable core 22 off the stator 21 caused by the collision of the stator 21 and the movable core 22 with each other when the fuel injection valve 1 opens. The suppressed bounce makes it possible to precisely control the amount of fuel injected by the fuel injection valve 1 when the valve opens.

When the movable core 22 is in contact with the stator 21, the fuel that exists between the movable core 22 and the stator 21 develops squeezing force between their contact surfaces. In general, when the squeezing force works on the movable core 22 and the stator 21, the movable core 22 is more difficult to be displaced away from the stator 21. In other words, when the greater squeezing force is applied or generated, the bounce or the chatter of the movable core 22 is more limited or more suppressed.

Because the movable core 22 and the needle 40 are separate parts as stated above, the bounce is greatly suppressed when the fuel injection valve 1 opens. In comparison with the conventional fuel injection valves, the smaller squeezing force is capable of sufficiently suppressing the bounce of the movable core 22 such that the fuel injection characteristic of the fuel injection valve 1 is limited from deteriorating. Also, it is possible to reduce the area of contact between the movable core 22 and the stator 21, which influences the squeezing force.

In the present embodiment, only the contact surface 231 of the movable core 22 comes into contact with the stator 21, and thereby the area of contact between the movable core 22 and the stator 21 is reduced to reduce the squeezing force.

When the current supply to the coil 51 is cut off, as stated above, no magnetic attractive force is developed between the stator 21 and the movable core 22 in contact with each other. This allows the movable core 22 to move out of contact with the stator 21, with the needle 40 moving away from the stator 21, so that the fuel injection valve 1 closes.

In the present embodiment, as stated above, the squeezing force between the movable core 22 and the stator 21 developed in a state, where the movable core 22 and the stator 21 are in contact with each other, is reduced. As a result, during an even of closing the fuel injection valve 1, the movable core 22 is less biased toward the stator 21 and thereby moves more easily in a direction away from the stator 21 or toward the nozzle hole 34. This improves the responsibility of the movement of the needle 40 with the movable core 22. Specifically, it is possible to shorten the period of time measured until timing, at which the needle 40 starts moving toward the nozzle hole 34, or the time period measured until timing, at which an closing operation for closing the nozzle hole 34 is started.

During the event of closing the fuel injection valve 1, the communicating passages 25 provide advantages as well. Specifically, after the movable core 22 leaves the stator 21, fuel is enabled to flow from the communicating passages 25 through the annular space 20 into the space between the contact surface 231 of the core 22 and the stator 21. Accordingly, even in the event of closing the fuel injection valve 1, it is possible to reduce the fluid resistance to the movable core 22, and thereby improving the responsibility of the movement of the needle 40 with the core 22. Specifically, it is possible to increase the speed of movement of the needle 40 toward the closing position for closing the nozzle hole 34. This shortens the period of time measured between timing, at which the closing operation of the valve 1 is started, and timing, at which the closing operation is completed. Also, the outer peripheral part of the needle stopper 401 and the corresponding inner peripheral part of the stator 21 defines a restrictor therebetween, which advantageously restricts communication of fuel between the stator 21 and the movable core 22.

The communicating passages 25 communicate with the annular space 20, which is formed between the non-contact surface 232 of the movable core 22 and the stator 21. In order not to deteriorate the effect of the squeezing force, the communicating passages 25 are positioned away from the contact surface 231 of the movable core 22, which influences the squeezing force. For example, the effect or advantage of the squeezing force includes suppressing the bounce such that the bounce does not influence the fuel injection characteristic of the fuel injection valve 1 when the valve opens. Accordingly, in the present embodiment, while the above effect in the event of opening the valve is achieved, it is also possible to obtain the other effect achieved through the communicating passages 25 when the fuel injection valve 1 closes.

When the fuel injection valve 1 closes, the separation structure of the needle 40 and movable core 22 also provides advantages as well. Specifically, when the movable core 22 and the needle 40 move together away from the stator 21 and the needle 40 is seated on (or collides with) the valve seat 32, the inertial weight of only the needle 40 is exerted on the seat 32. This greatly suppresses the bounce of the needle 40 off the valve seat 32 created when the fuel injection valve 1 closes. As a result, the greatly suppressed bounce limits the excessive or unwanted fuel injection (secondary injection) caused by the bounce after the fuel injection valve 1 is once closed.

As stated above, the separation of the movable core 22 and the needle 40 suppresses the bounce created when the fuel injection valve 1 opens. The suppressed bounce results in the reduction of the squeezing force necessary for the bounce suppression when the fuel injection valve 1 opens. This shortens the time taken until the needle 40 starts to move toward the valve seat 32 (move in the direction for closing the nozzle hole 34) in the event of closing the valve. The formation of the communicating passages 25 also increases the speed of the movement of the needle 40 toward the valve seat 32 in the closing operation of the valve 1. The above increased speed shortens the period of time measured between timing, at the closing operation of the valve is started, and timing, at which the closing operation is completed.

Figure 4A:
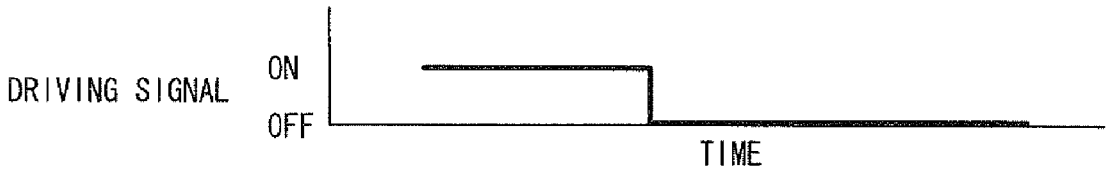
FIG. 4A is a graph showing a driving signal generated when the valve closes in the first embodiment.
Figure 4B:
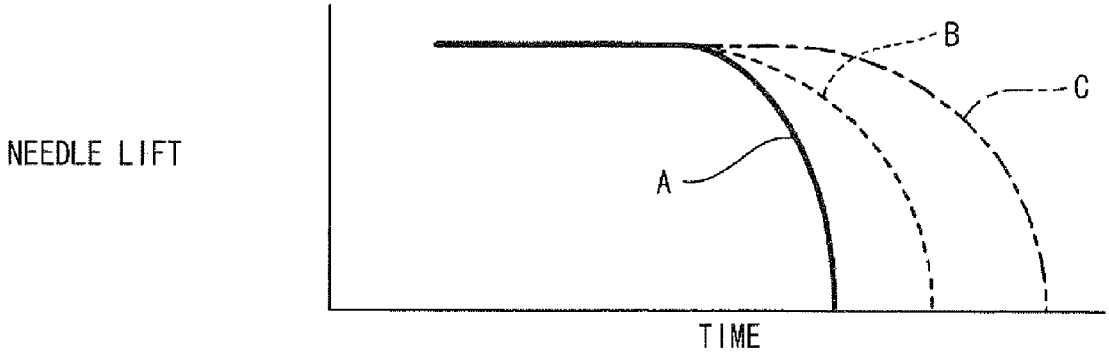
FIG. 4B is a graph showing a lift waveform of the valve made when the valve closes in the first embodiment.

FIGS. 4A and 4B show the foregoing effects.

In FIG. 4A, ON and OFF of a driving signal are shown in the even of closing the fuel injection valve 1, and the horizontal axis in FIG. 4A represents time. FIG. 4B shows the waveforms of lifts (lift waveforms) of the needle 40 in response to the driving signal. In FIG. 4B, the vertical and horizontal axes represent needle lift and time, respectively.

As shown by the lift waveform C of a conventional fuel injection valve in FIG. 4B, there is a large latency between timing, at which the driving signal is switched to OFF, and timing, at which a needle of the conventional fuel injection valve starts to move in the closing direction (or the needle lift starts to lower). Also, the conventional valve takes a relatively long time to complete the valve closing operation after the needle starts moving in the closing direction as shown by the lift waveform C. In other words, the conventional valve takes a relatively long time until the needle lift becomes 0 (e.g., until the closing operation for closing the valve is completed) since the needle starts to move in the closing direction (e.g., since the closing operation is started).

Because the movable core 22 and the needle 40 of the fuel injection valve 1 are separate parts, it is possible to suppress the bounce created when the valve opens. This reduces the squeezing force necessary for suppressing the bounce when the fuel injection valve 1 opens. The reduction of the squeezing force shortens the time taken until the needle 40 starts to move toward the valve seat 32 (lift waveform B in FIG. 4B).

The formation of the communicating passages 25 also increases the speed of movement of the needle 40 toward the valve seat 32. This shortens the time period measured between timing, at which the closing operation is started, and timing, at which the closing operation is completed, as shown in a lift waveform A in FIG. 4B. As above, the fuel injection valve 1 of the present embodiment operates as shown by the lift waveform A.

In addition to the foregoing effects and advantages, the separation of the movable core 22 and the needle 40 suppresses the bounce created when the fuel injection valve 1 closes. The formation of the communicating passages 25 increases the speed of the movement of the needle 40 in the direction away from the valve seat 32. The increased speed shortens a period of time measured between timing, at which the opening operation for opening the nozzle hole 34 is started, and timing, at which the opening operation is completed.

Second Embodiment

FIGS. 5A to 7B show fuel injection valves according to the second embodiment of the present invention. In each of these valves, the movable core 22 has communicating passages 25 positioned differently from those in the first embodiment.

Figure 5A:
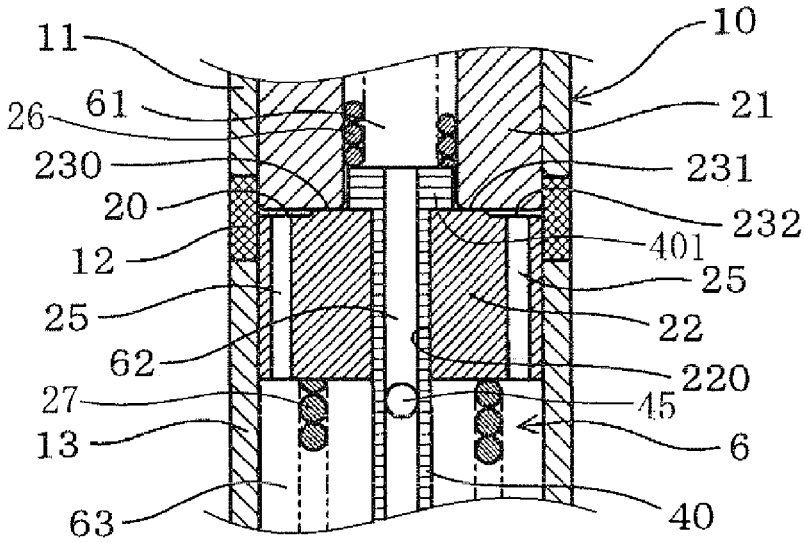
FIG. 5A is an axial section of part of a fuel injection valve according to the second embodiment of the present invention, showing the positions of the communicating passages of the movable core of the valve.
Figure 6A:
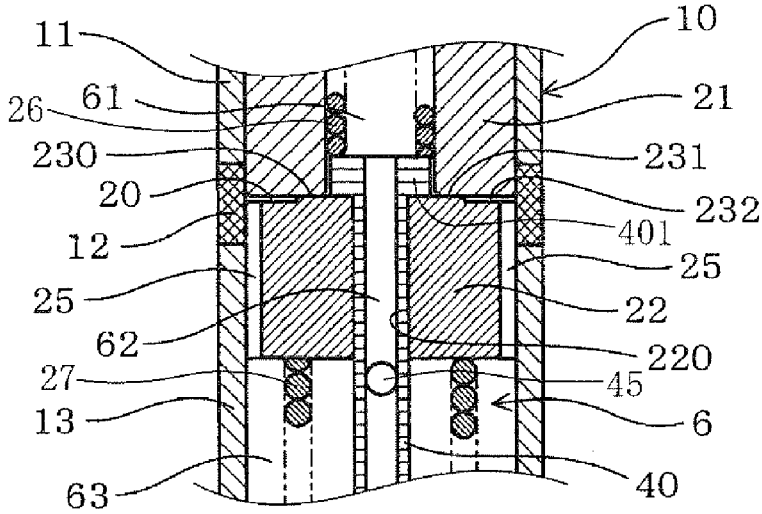
FIG. 6A is an axial section of part of another fuel injection valve according to the second embodiment, showing the positions of the communicating passages of the movable core of the valve.
Figure 7A:
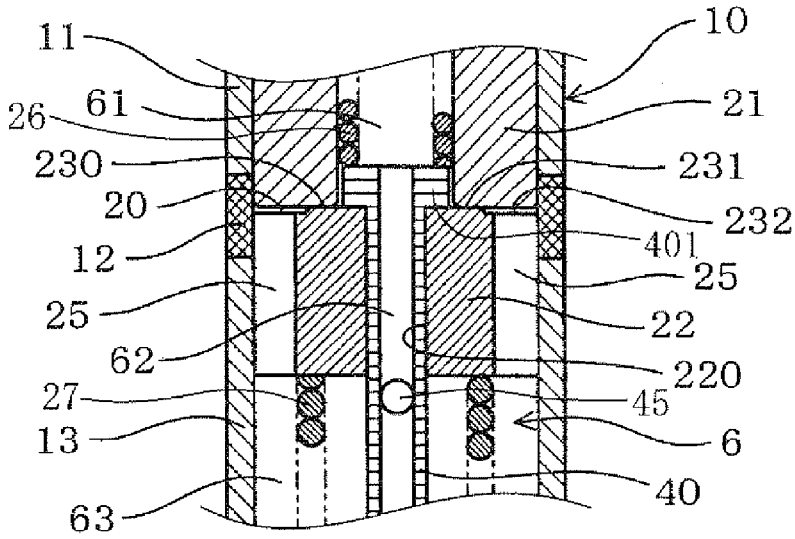
FIG. 7A is an axial section of part of still another fuel injection valve according to the second embodiment, showing the positions of the communicating passages of the movable core of the valve.

In each of FIGS. 5A, 6A, and 7A, the movable core 22 is in contact with the stator 21.

Figure 5B:
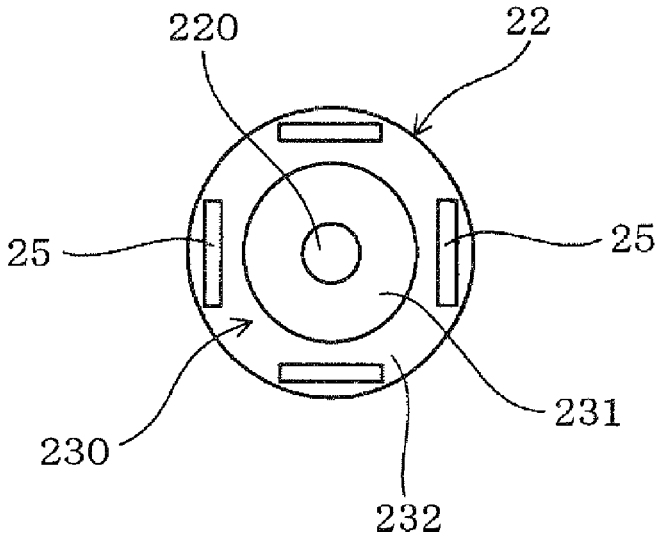
FIG. 5B is a rear end view of the movable core shown in FIG. 5A.

FIGS. 5A and 5B show a fuel injection valve in which the movable core 22 has four communicating passages 25 formed to extend through the movable core 22 as is the case with the first embodiment.

In FIGS. 5A and 5B, the communicating passages 25 are rectangular in section and positioned at intervals of 90 degrees near the outer periphery of the movable core 22.

In this case, the second communicating passage 25 sufficiently has the effect of improving the responsibility of the valve member 40, and thereby improving the injection characteristic of the fuel injection valve 1. In addition, the second communicating passage 25 is easy to form by working the inner peripheral surface 221 or the outer peripheral surface 222 of the movable core 22 advantageously.

FIGS. 6A to 7B show fuel injection valves in each of which the movable core 22 has communicating passages 25, which are formed as cutouts formed on the outer peripheral surface 222.

Figure 6B:
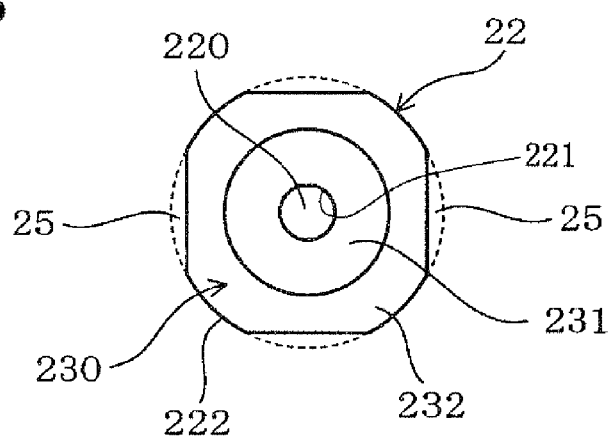
FIG. 6B is a rear end view of the movable core of the another fuel injection valve according to the second embodiment, showing the positions of the communicating passages of the core.

In FIGS. 6A and 6B, the four communicating passages 25 are cutouts straightly formed at intervals of 90 degrees at the outer peripheral surface 222 of the movable core 22.

Figure 6C:
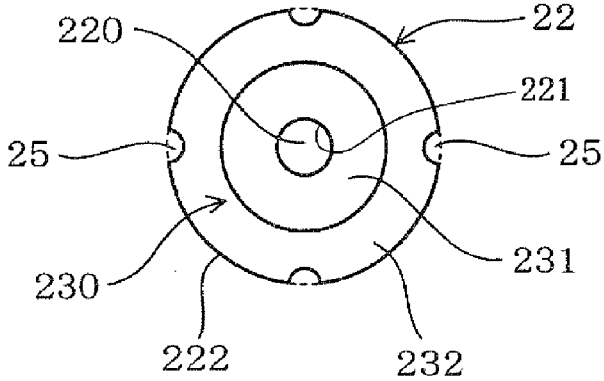
FIG. 6C is a rear end view of the movable core of still another fuel injection valve according to the second embodiment, showing the positions of the communicating passages of the core.

In FIG. 6C, each of the four communicating passages 25 is formed to have a semicircular shape in section, and the communicating passages 25 are cutouts formed at intervals of 90 degrees at the outer peripheral surface 222 of the movable core 22.

Figure 7B:
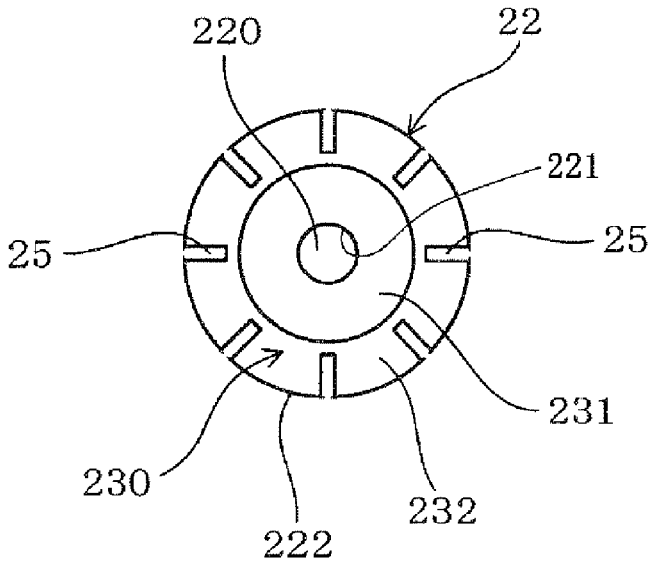
FIG. 7B is a rear end view of the movable core shown in FIG. 7A.

In FIGS. 7A and 7B, the eight communicating passages 25 are cutouts or grooves formed at intervals of 45 degrees at the outer peripheral surface 222 of the movable core 22. Each of the eight communicating passages 25 has a rectangular shape in section.

The fuel injection valves of the second embodiment shown in FIGS. 5A to 7B are similar in structure to the fuel injection valve of the first embodiment, and thereby advantages of the fuel injection valve 1 of the first embodiment are also achieved in the second embodiment.

The communicating passages 25 may be cutouts formed at the inner peripheral surface 221 of the movable core 22.

Third Embodiment

FIGS. 8A to 11B show fuel injection valves according to the third embodiment of the present invention. In each of these valves, the stator 21 defines communicating passages 24 therein in place of the communicating passages 25 of the movable core 22 in the first and second embodiments.

As shown in FIGS. 8A to 11B, the stator 21 defines the communicating passages 24 that connect the annular space 20 with the fuel passage 61, which corresponds to the first fuel passage of the fuel channel 6 positioned upstream of the movable core 22.

In each of FIGS. 8A, 9A, 10A, and 11A, the movable core 22 is in contact with the stator 21.

FIGS. 8A to 9B show fuel injection valves in each of which the stator 21 defines four communicating passages 24 therein that extend through the stator 21.

Figure 8A:
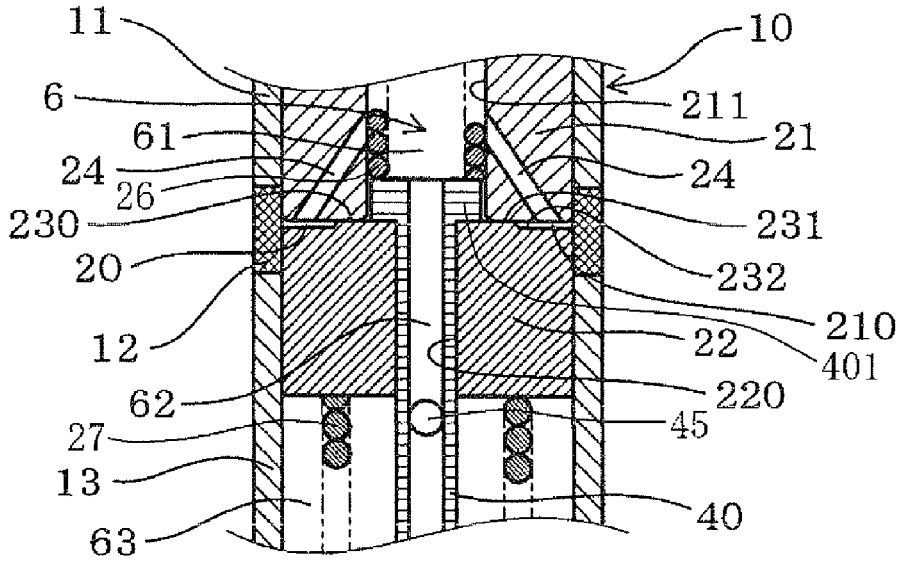
FIG. 8A is an axial section of part of a fuel injection valve according to the third embodiment of the present invention, showing the positions of the communicating passages of the stator of the valve.
Figure 8B:
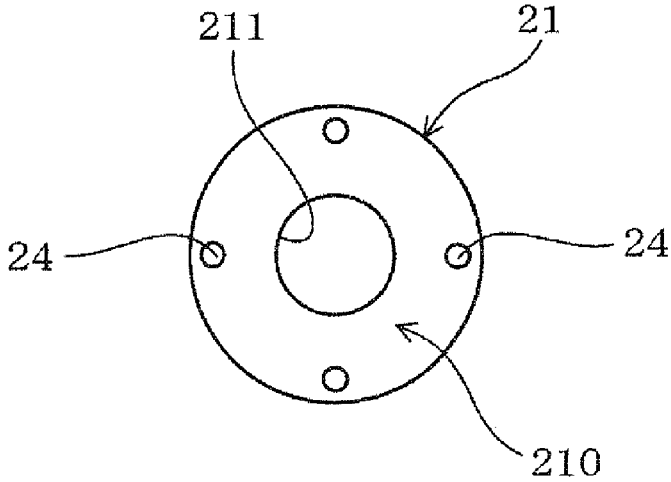
FIG. 8B is a front end view of the stator shown in FIG. 8A.

More specifically, in FIGS. 8A and 8B, the communicating passages 24 extend open at the inner peripheral surface 211 of the stator 21 and to open at the front end face 210 of the stator, which is adjacent to the movable core 22. Each of the communicating passages 24 has a circular shape in section. The front ends of the communicating passages 24 are arranged circumferentially one after another at intervals of 90 degrees near the outer periphery of the stator end face 210.

Figure 9A:
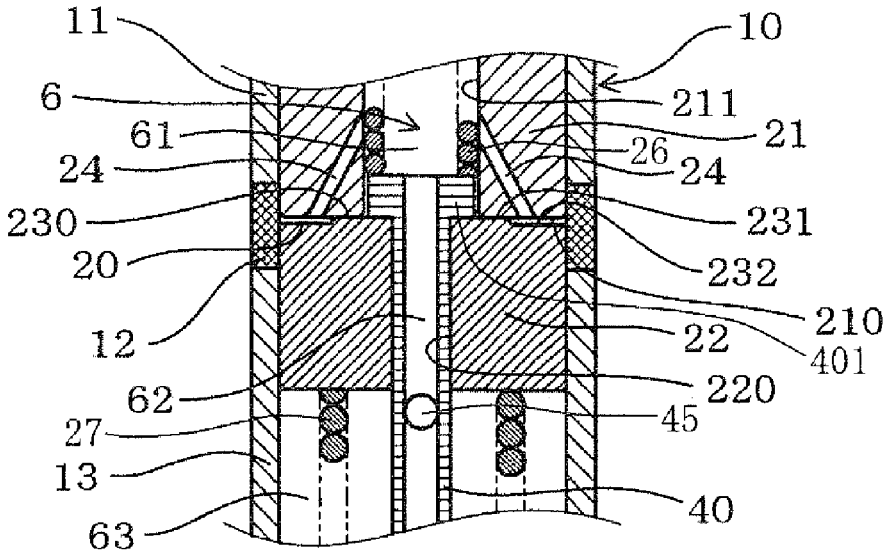
FIG. 9A is an axial section of part of still another fuel injection valve according to the third embodiment, showing the positions of the communicating passages of the stator of the valve.
Figure 9B:
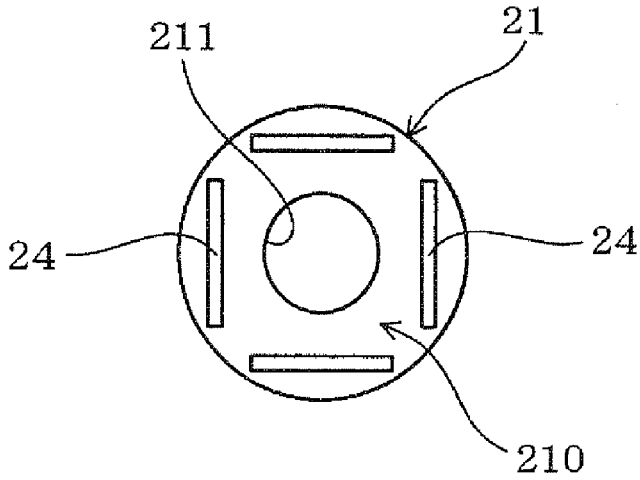
FIG. 9B is a front end view of the stator shown in FIG. 9A.

In FIGS. 9A and 9B, the communicating passages 24 extend to open at the inner peripheral surface 211 and at the front end face 210 of the stator 21. Each of the communicating passages 24 has a rectangular shape in section. The front ends of the communicating passages 24 are arranged circumferentially one after another at intervals of 90 degrees near the outer periphery of the stator end face 210

FIGS. 10A to 11B show fuel injection valves in each of which the stator 21 has communicating passages 24 that are cutouts formed at the inner peripheral surface 211 of the stator 21.

Figure 10A:
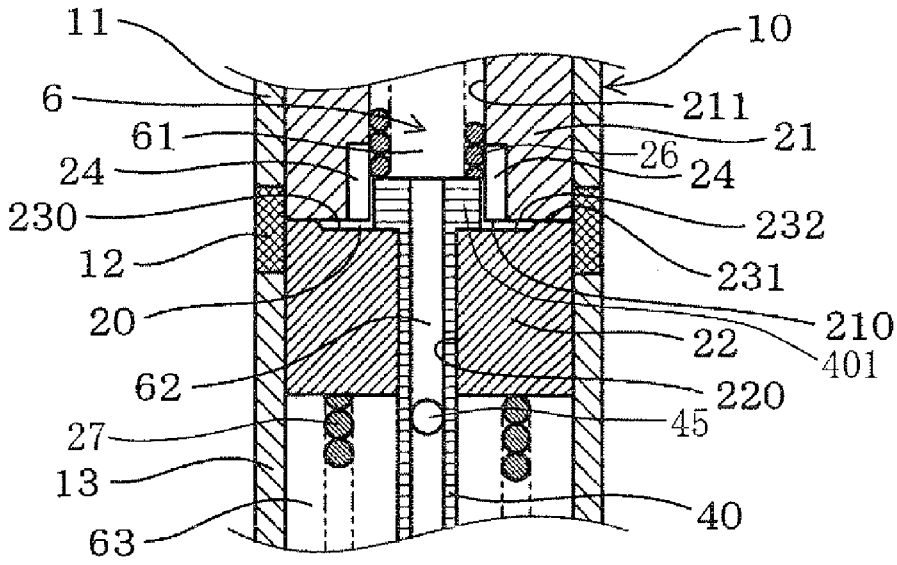
FIG. 10A is an axial section of part of still another fuel injection valve according to the third embodiment, showing the positions of the communicating passages of the stator of the valve.
Figure 10B:
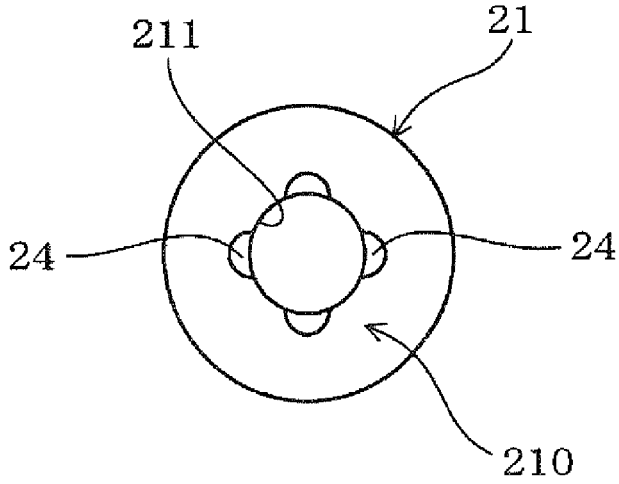
FIG. 10B is a front end view of the stator shown in FIG. 10A.

In FIGS. 10A and 10B, four communicating passages 24 are cutouts circumferentially arranged one after another at intervals of 90 degrees at the inner peripheral surface 211 of the stator 21. Each of the communicating passages 24 has a semicircular shape in section.

Figure 11A:
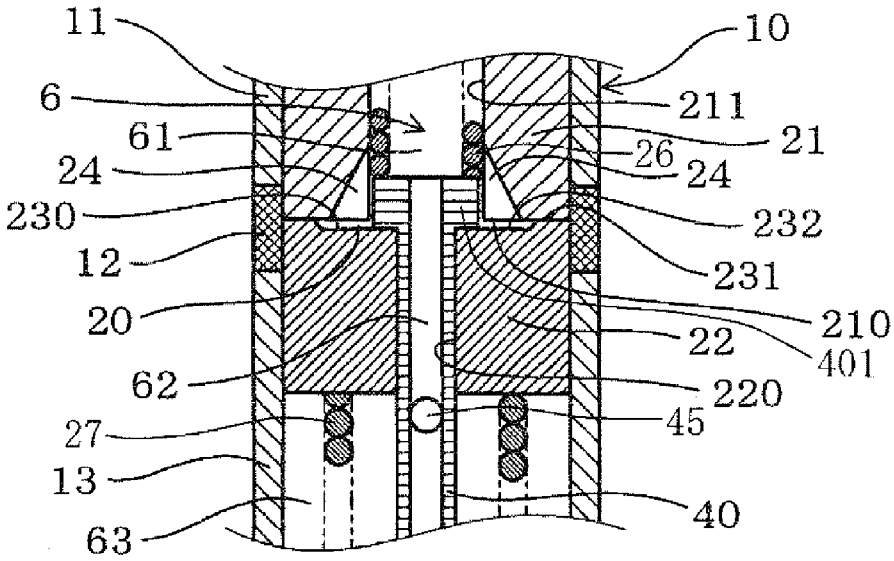
FIG. 11A is an axial section of part of still another fuel injection valve according to the third embodiment, showing the positions of the communicating passages of the stator of the valve.
Figure 11B:
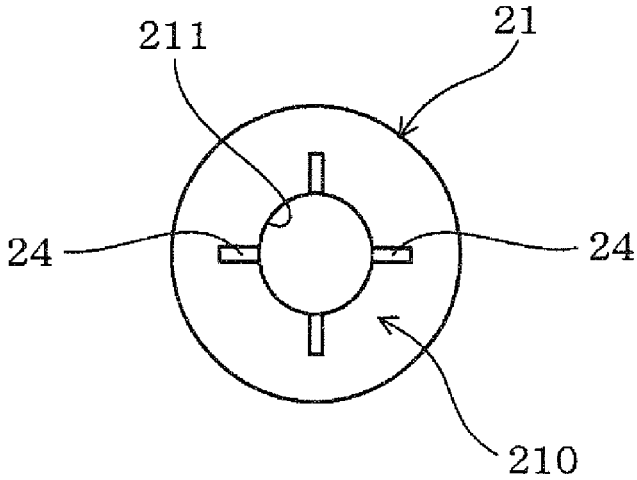
FIG. 11B is a front end view of the stator shown in FIG. 11A.

In FIGS. 11A and 11B, four communicating passages 24 are cutouts circumferentially arranged one after another at intervals of 90 degrees at the inner peripheral surface 211 of the stator 21. Each of the communicating passages 24 has a rectangular shape in section.

In the present embodiment, the first communicating passage 24 sufficiently has the effect of improving the responsibility of the valve member 40, and thereby improving the injection characteristic of the fuel injection valve 1. In addition, the first communicating passage 24 is easy to form by working the inner peripheral surface 211 of the stator 21 advantageously.

The fuel injection valves of the third embodiment shown in FIGS. 8A to 11B are similar in structure and advantage to the fuel injection valve according to the first embodiment. In other words, the communicating passages 24 of the stators 21 achieve the effects achieved by the communicating passages 25 of the movable cores 22.

The movable core 22 of each fuel injection valve may also have communicating passages 25 of the first and second embodiments in addition to the communicating passages 24 defined in the stator 21 of the present embodiment.

Fourth Embodiment

FIGS. 12A to 13C show fuel injection valves according to the fourth embodiment of the present invention. In each of these valves, the front end face 210 of the stator 21 and the rear end face 230 of the movable core 22 differ in shape from those in the first embodiment. The core end face 230 includes a contact surface 231 and a non-contact surface 232, which are positioned differently from those in the first embodiment.

In each of FIGS. 12A to 13C, the movable core 22 is in contact with the stator 21.

Figure 12A:
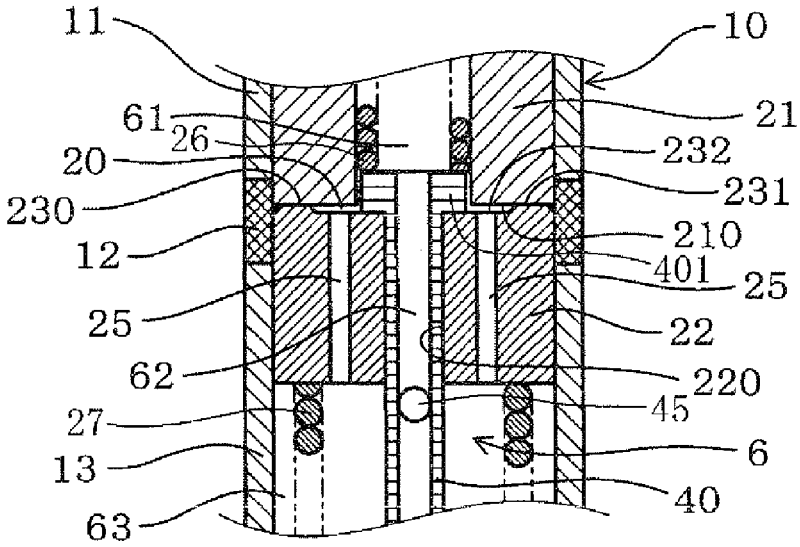
FIG. 12A is an axial section of part of a fuel injection valve according to the fourth embodiment of the present invention, showing the shapes of the front end face of the stator of the valve and the rear end face of the movable core of the valve, and also showing the positions of the contact and non-contact surfaces of the core.
Figure 12B:
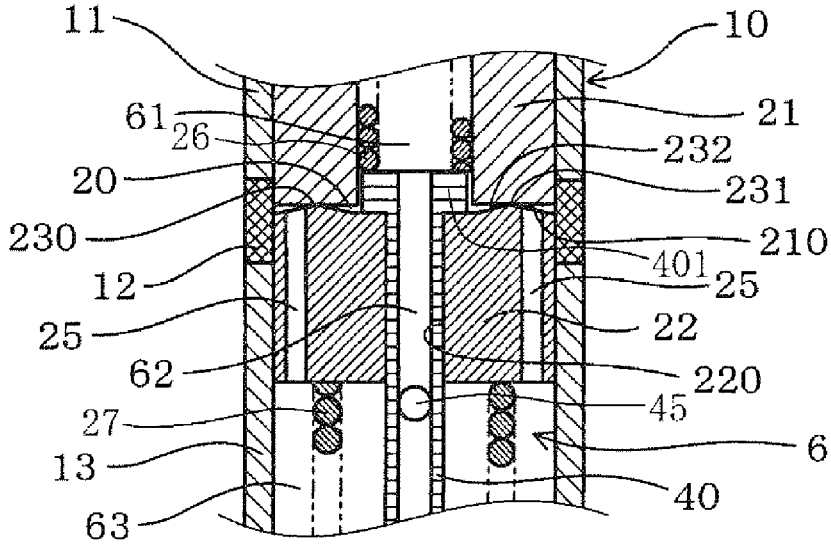
FIG. 12B is an axial section of part of another fuel injection valve according to the fourth embodiment of the present invention, showing the shapes of the front end face of the stator of the valve and the rear end face of the movable core of the valve, and also showing the positions of the contact and non-contact surfaces of the core.

FIGS. 12A and 12B show fuel injection valves in each of which, as is the case with the first embodiment, the facing region of the rear end face 230 of the movable core 22, which is opposed to or faces the stator 1, has a contact surface 231 a non-contact surfaces 232. For example, the contact surface 231 corresponds to a protruding part of the facing region of the rear end face 230, which axially protrudes toward the stator 1, and the non-contact surfaces 232 corresponds to the other part of the facing region other than the contact surface 231.

In FIG. 12A, the rear end face 230 of the movable core 22 has the contact surface 231 at the radially outer part of the end face 230 and the non-contact surface 232 at the radially inner part.

In FIG. 12B, the rear end face 230 of the movable core 22 has the non-contact surface 232 at the radially inward part and at the radially outward part of the end face 230. Also, the rear end face 230 has the contact surface 231 at the radially intermediate part of the end face 230, which protrudes axially toward the stator 21.

Figure 13A:
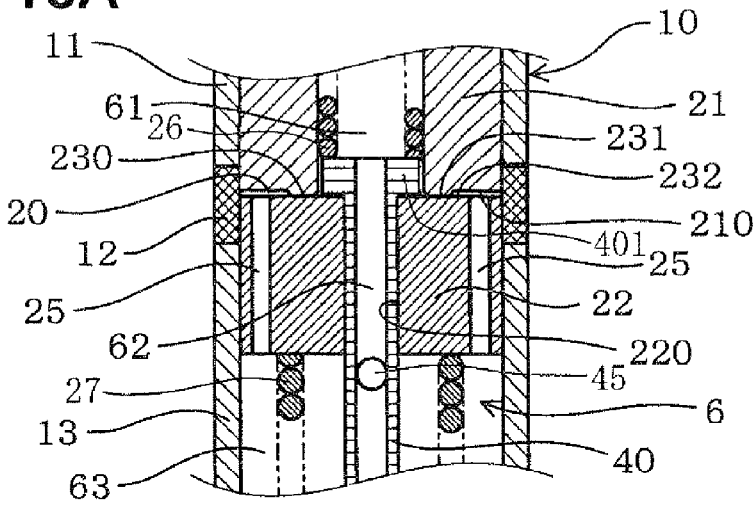
FIG. 13A is an axial section of part of another fuel injection valve according to the fourth embodiment, showing the shapes of the front end face of the stator of the valve and the rear end face of the movable core of the valve, and also showing the positions of the contact and non-contact surfaces of the core.
Figure 13B:
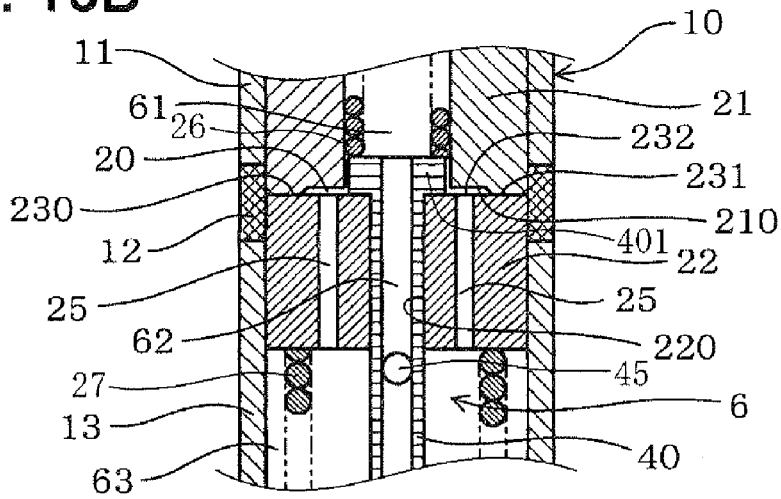
FIG. 13B is an axial section of part of another fuel injection valve according to the fourth embodiment, showing the shapes of the front end face of the stator of the valve and the rear end face of the movable core of the valve, and also showing the positions of the contact and non-contact surfaces of the core.
Figure 13C:
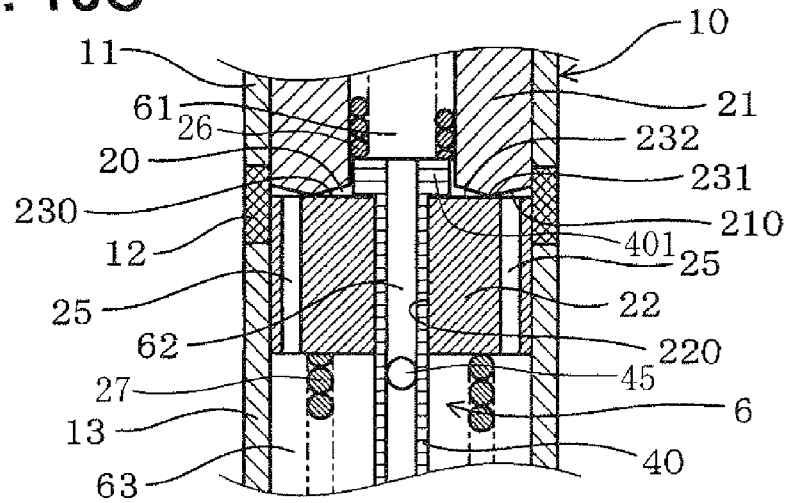
FIG. 13C is an axial section of part of another fuel injection valve according to the fourth embodiment, showing the shapes of the front end face of the stator of the valve and the rear end face of the movable core of the valve, and also showing the positions of the contact and non-contact surfaces of the core.

FIGS. 13A to 13C show fuel injection valves in each of which the front end face 210 of the stator 21 partially protrudes toward the movable core 22 such that the facing region of the rear end face 230 of the movable core 22 has a contact surface 231 and a non-contact surface 232. The contact surface 231 corresponds to a part of the facing region of the rear end face 230, which is contactable with the protruding part of the end face 210 of the stator 12, and the non-contact surface 232 corresponds to other part of the facing region other than the contact surface 231.

In FIG. 13A, the radially inward part of the front end face 210 of the stator 21 axially protrudes toward the movable core 22. In FIG. 13A, the rear end face 230 of the movable core 22 includes the contact surface 231 at the radially inward part of the rear end face 230 and the non-contact surface 232 at the radially outward part of the rear end face 230.

In FIG. 13B, the radially outward part of the front end face 210 of the stator 21 axially protrudes toward the movable core 22. In FIG. 13B, the rear end face 230 of the movable core 22 includes the contact surface 231 at the radially outward part of the rear end face 230 and the non-contact surface 232 at the radially inward part of the rear end face 230.

In FIG. 13C, a radially intermediate part of the front end face 210 of the stator 21 axially protrudes toward the movable core 22. In FIG. 13C, the rear end face 230 of the movable core 22 includes the non-contact surface 232 at the radially inward part and the radially outward part of the rear end face 230. Also, the rear end face 230 includes the contact surface 231 at the radially intermediate part of the rear end face 230.

The fuel injection valves of the fourth embodiment shown in FIGS. 13A to 13C are similar in structure to the fuel injection valve 1 of the first embodiment, and thereby the fuel injection valve of the fourth embodiment achieves advantages similar to those of the fuel injection valve 1 according to the first embodiment.

Fifth Embodiment

The fifth embodiment of the present invention is an evaluation of the performance of the fuel injection valve 1 according to the first embodiment.

An area ratio is defined as a ratio of (a) a total area of openings of the communicating passages 25 of the moving core 22 to (b) an area of the facing region of the rear end face 230 of the movable core 22 of the fuel injection valve 1 with reference to FIGS. 1 to 3. In the above, the opening of each of the communicating passages 25 opens at the rear end face 230 to communicate with the space 20, and the facing region of the rear end face 230 axially is opposed to or faces the stator 21. The change of responsibility of the needle is studied in accordance with the change of the area ratio. Also, the change of the magnetic attractive force developed between the movable core 22 and the stator 21 is studied in accordance with the change of the area ratio. For example, the responsibility of the needle corresponds to a valve opening period.

Figure 14:
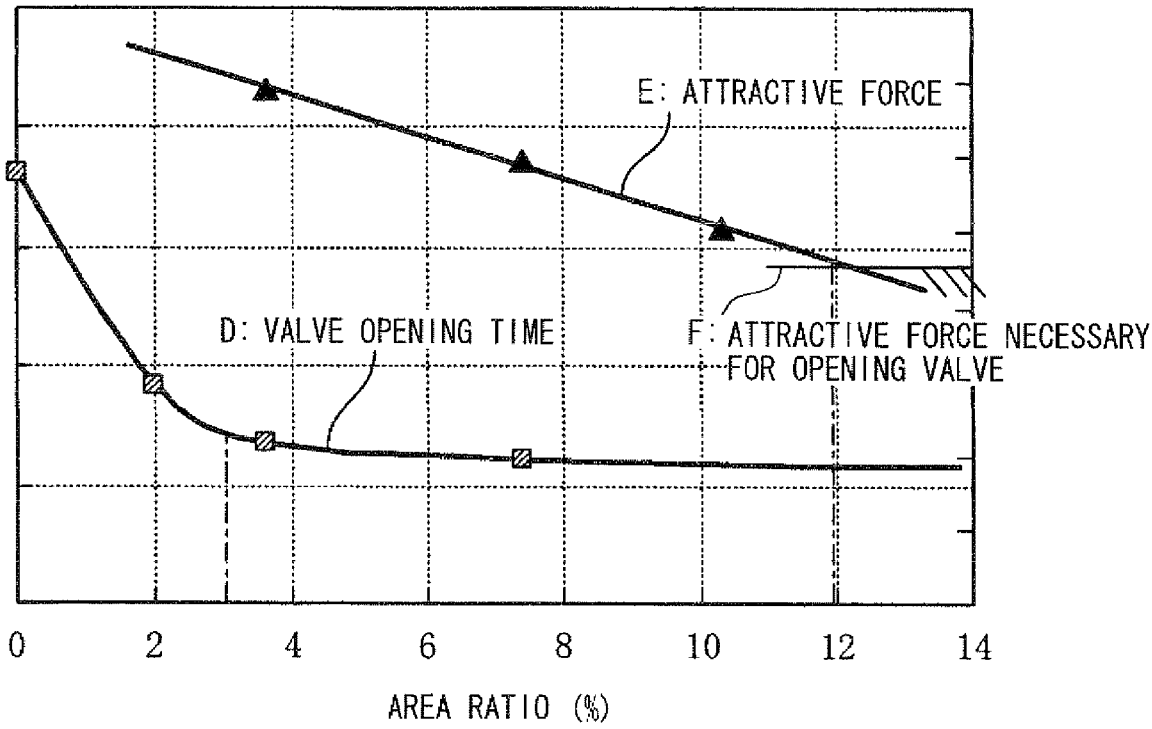
FIG. 14 is a chart showing a relationship between an area ratio and a valve opening period of time and showing another relationship between the area ratio and the attractive force in the first embodiment.
Figure 15:
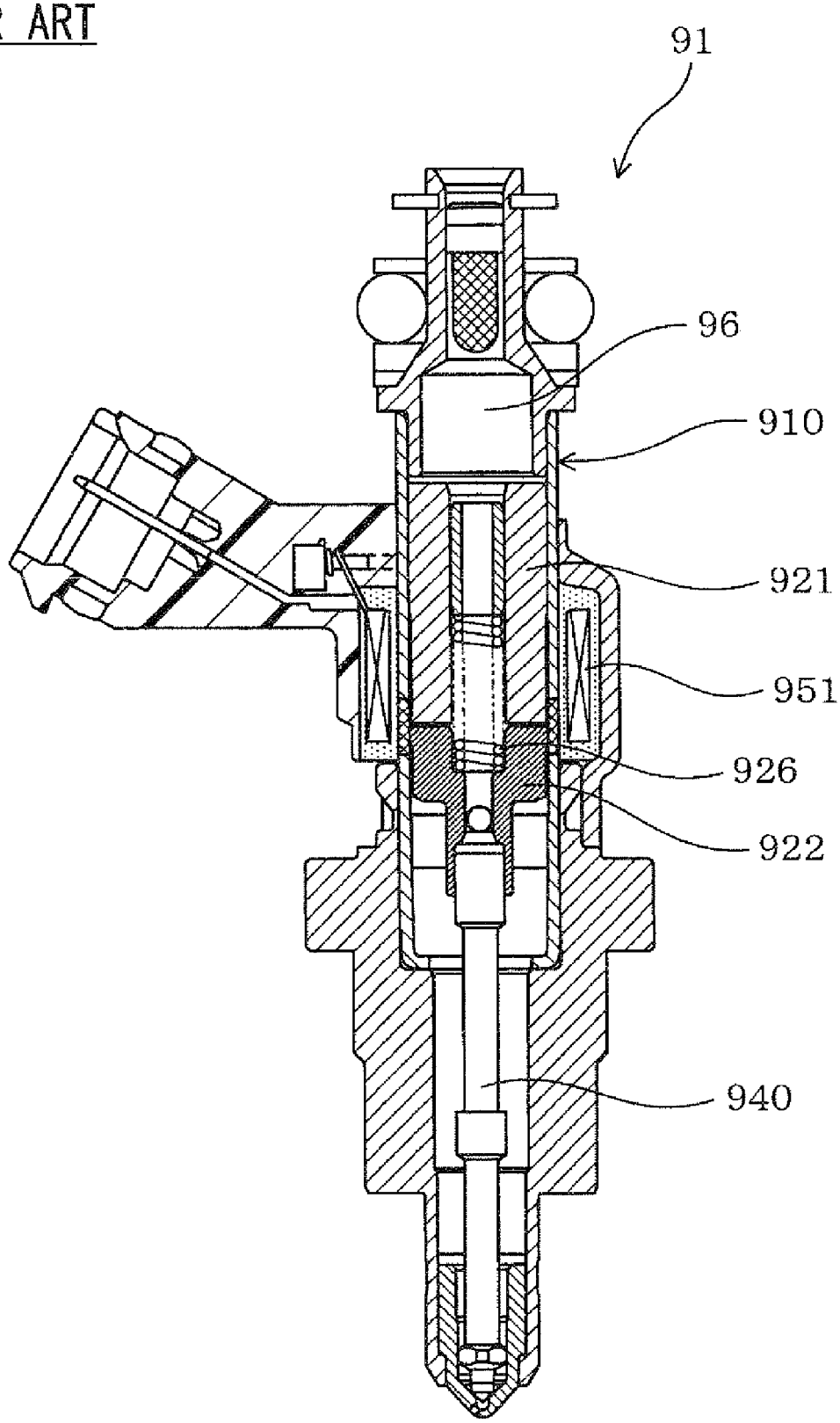
FIG. 15 PRIOR ART
FIG. 15 is an axial section of a conventional injector.

The studied needle responsibility and attractive force are shown in FIG. 14.

In a case, where the area ratio is lower than 3%, the needle responsibility is lower (valve opening period D is longer) as shown in FIG. 14. In another case, where the area ratio is higher than 12%, the magnetic attractive force E is smaller than a magnetic attractive force F necessary for opening the fuel injection valve 1 as shown in FIG. 14. Therefore, it is preferable that the area ratio be in a range from 3 to 12%.

In a case, where the area ratio is lower than 3%, it may be impossible to sufficiently reduce the fluid resistance applied to the movable core 22 in the event of opening and closing the fuel injection valve 1. As a result, the responsibility of the valve member 40 may deteriorate. In another case, where the area ratio is higher than 12%, it may also be impossible to sufficiently secure the magnetic attractive force that is required to open the fuel injection valve 1.

In the above, the communicating passages 25 of the movable core 22 are provided to the valve of the first embodiment. However, the above relationship between the area ratio and the needle responsibility and the relationship between the area ratio and the magnetic attractive force are also applicable to another case, where the communication passages 24 of the stator core 21 are provided to the valve of other embodiment.

For example, an area ratio is alternatively defined as a ratio of (a) a total area of openings of the communicating passages 24 of the stator 21 to (b) an area of the facing region of the rear end face of the stator 21 of the fuel injection valve 1. In the above, the opening of each of the communicating passages 24 opens at the rear end face to communicate with the space 20, and the facing region of the rear end face axially is opposed to the movable core 22. In the above alternative case, the area ratio is defined in a range from 3 to 12%.

In the above embodiments, the end face of the movable core 22 that is adjacent to the stator 21 includes the region facing the stator 21. The facing region includes the non-contact surface 232 that is prevented from contacting the stator 21 and the contact surface 231 that is brought into contact with the stator 21 when the stator 21 attracts the movable core 22. The non-contact surface 232 and the stator 21 define the space 20 between them. The fuel channel 6 includes the first fuel passage 61 defined inside the stator 21 upstream of the movable core 22 and includes the second fuel passage 63 downstream of the movable core 22. In the above embodiments, the fuel injection valve 1 has at least one of (a) the first communicating passage 24 defined in the stator 21 and (b) the second communicating passage 25 defined in the movable core 22. The first communicating passage 24 connects the first fuel passage 61 with the space 20. The second communicating passage 25 connects the second fuel passage 63 with the space 20.

Accordingly, the space 20 and the first and second communicating passages 61, 63, which communicate with the space 20, function as passageways through which the fuel between the movable core 22 and the stator 21 escapes to the corresponding fuel channel 6.

Additional advantages and modifications will readily occur to those skilled in the art. The invention in its broader terms is therefore not limited to the specific details, representative apparatus, and illustrative examples shown and described.

What is claimed is:

1. A fuel injection valve comprising:

a tubular housing that defines a fuel channel therein, through which fuel flows;

a tubular stator that is received in the housing;

a tubular movable core that is received in the housing, wherein:

the movable core is axially opposed to the stator;

the movable core defines a bore formed therethrough;

the movable core has an end face adjacent to the stator;

the end face has a region that is opposed to the stator;

the region includes a non-contact surface, which is prevented from contacting the stator, and a contact surface, which is adapted to contact the stator; and the non-contact surface and the stator define a space therebetween when the contact surface contact the stator;

a coil that is adapted to generate a magnetic field when the coil is energized to develop magnetic attractive force between the stator and the movable core, wherein the magnetic attractive force causes the stator to attract the movable core such that the contact surface of the movable core is brought into contact with the stator;

a nozzle hole that is positioned on a downstream end of the housing in a flow direction of fuel;

a valve member that is slidably received in the bore of the movable core, wherein:

the valve member extends through the bore;

the valve member is separate from the movable core;

the valve member includes a body and a stopper that radially outwardly projects from the body; and the stopper of the valve member is configured to engage with the movable core such that the valve member is axially movable together with the movable core in order to control injection of fuel through the nozzle hole; and at least one communicating passage that is coupled to the space, wherein:

the fuel channel includes:

a first fuel passage defined inside the stator upstream of the movable core in the flow direction; and a second fuel passage located downstream of the movable core in the flow direction; and the at least one communicating passage connects the space with a corresponding one of the first fuel passage and the second fuel passage.

2. The fuel injection valve according to claim 1, wherein:

the at least one communicating passage is defined in the stator and connects the first fuel passage with the space, and the at least one communicating passage extends through the stator.

3. The fuel injection valve according to claim 1, wherein:

the at least one communicating passage is defined in the stator and connects the first fuel passage with the space; and the at least one communicating passage is a cutout formed at an inner peripheral surface of the stator.

4. The fuel injection valve according to claim 1, wherein:

the at least one communicating passage is defined in the movable core and connects the second fuel passage with the space; and the at least one communicating passage extends through the movable core.

5. The fuel injection valve according to claim 2, wherein:

the at least one communicating passage defined in the stator is a first communicating passage;

the at least one communicating passage further includes a second communicating passage defined in the movable core and connecting the second fuel passage with the space; and the second communicating passage extends through the movable core.

6. The fuel injection valve according to claim 1, wherein:

the at least one communicating passage is defined in the movable core and connects the second fuel passage with the space; and the at least one communicating passage is a cutout formed at one of an inner peripheral surface and an outer peripheral surface of the movable core.

7. The fuel injection valve according to claim 2, wherein the at least one communicating passage defined in the stator is a first communicating passage;

the at least one communicating passage further includes a second communicating passage defined in the movable core and connecting the second fuel passage with the space; and the at least one communicating passage is a cutout formed at one of an inner peripheral surface and an outer peripheral surface of the movable core.

8. The fuel injection valve according to claim 1 wherein:

the at least one communicating passage is defined in the stator and connects the first fuel passage with the space;

the at least one communicating passage has an opening that opens to the space;

the stator has an end face adjacent to the movable core;

the end face of the stator has a region that is opposed to the movable core; and a ratio of an area of the opening of the at least one communicating passage to an area of to the region of the end face of the stator is 3 to 12%.

9. The fuel injection valve according to claim 2, wherein:

the at least one communicating passage has an opening that opens to the space;

the stator has an end face adjacent to the movable core;

the end face of the stator has a region that is opposed to the movable core; and a ratio of an area of the opening of the at least one communicating passage to an area of to the region of the end face of the stator is 3 to 12%.

10. The fuel injection valve according to claim 5, wherein:

the first communicating passage has an opening that opens to the space;

the stator has an end face adjacent to the movable core;

the end face of the stator has a region that is opposed to the movable core; and a ratio of an area of the opening of the first communicating passage to an area of to the region of the end face of the stator is 3 to 12%.

11. The fuel injection valve according to claim 1, wherein:

the at least one communicating passage is defined in the movable core and connects the second fuel passage with the space;

the at least one communicating passage has an opening that opens to the space; and a ratio of an area of the opening of the at least one communicating passage to an area of the region of the end face of the movable core is 3 to 12%.

12. The fuel injection valve according to claim 4, wherein:

the at least one communicating passage has an opening that opens to the space; and a ratio of an area of the opening of the at least one communicating passage to an area of the region of the end face of the movable core is 3 to 12%.

13. The fuel injection valve according to claim 5, wherein:

the second communicating passage has an opening that opens to the space; and a ratio of an area of the opening of the second communicating passage to an area of the region of the end face of the movable core is 3 to 12%.

* * * * *